US010551763B2

(12) United States Patent
Yoshida et al.

(10) Patent No.: US 10,551,763 B2
(45) Date of Patent: Feb. 4, 2020

(54) IMAGE FORMING APPARATUS AND CARTRIDGE HAVING A CHARGING ROLLER WITH A SURFACE LAYER INCLUDING PROJECTIONS

(71) Applicant: CANON KABUSHIKI KAISHA, Tokyo (JP)

(72) Inventors: Michihiro Yoshida, Nagareyama (JP); Takeshi Fujino, Abiko (JP); Kota Mori, Abiko (JP); Yuya Nagatomo, Toride (JP); Jiro Kinokuni, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/006,072

(22) Filed: Jun. 12, 2018

(65) Prior Publication Data

US 2018/0364605 A1 Dec. 20, 2018

(30) Foreign Application Priority Data

Jun. 15, 2017 (JP) ..... 2017-118141

(51) Int. Cl.
*G03G 15/02* (2006.01)
*G03G 21/18* (2006.01)

(52) U.S. Cl.
CPC ..... *G03G 15/0258* (2013.01); *G03G 21/1814* (2013.01)

(58) Field of Classification Search
CPC ..... G03G 15/0258; G03G 15/0225; G03G 15/0233; G03G 21/1814
See application file for complete search history.

(56) References Cited

U.S. PATENT DOCUMENTS 6,128,462 A 10/2000 Kato et al.
6,169,869 B1 1/2001 Inami et al.
6,175,703 B1 1/2001 Nakazono et al.
(Continued)

FOREIGN PATENT DOCUMENTS

EP 3 048 489 A1 7/2016
JP 4047057 B2 2/2008
(Continued)

OTHER PUBLICATIONS

U.S. Appl. No. 16/006,945, filed Jun. 13, 2018.
Extended Search Report in European Patent Application No. 18 174 720.5, dated Sep. 18, 2018.

*Primary Examiner* — G. M. A Hyder
(74) *Attorney, Agent, or Firm* — Venable LLP

(57) ABSTRACT

An image forming apparatus includes a photosensitive member, a charging roller, a cleaning roller, an urging member and an image forming portion. The charging roller has an outermost surface layer including an electroconductive resin material, first surface particles having an average particle size of more than 7 μm and less than 30 μm and second surface particles having an average particle size of more than 2 μm and less than 6 μm. The first and second surface particles are dispersed in the electroconductive resin material so as to form first projections and second projections, respectively. The cleaning roller cleaning roller includes a shaft portion and an elastic cleaning portion extending helically around the shaft portion and having a rectangular cross-section perpendicular to an extending direction thereof.

14 Claims, 7 Drawing Sheets

(56) References Cited

U.S. PATENT DOCUMENTS

| | | | | |
|---|---|---|---|---|
| 6,337,964 | B2 | 1/2002 | Inami et al. | |
| 6,539,190 | B2 | 3/2003 | Oba et al. | |
| 6,898,401 | B2 | 5/2005 | Okano et al. | |
| 6,963,706 | B2 | 11/2005 | Morioka et al. | |
| 7,398,040 | B2 | 7/2008 | Yoshida | |
| 7,551,878 | B2 | 6/2009 | Ogaki et al. | |
| 7,835,669 | B2 * | 11/2010 | Furukawa | G03G 15/0233 399/176 |
| 9,335,705 | B1 | 5/2016 | Fukuzawa et al. | |
| 2010/0046987 | A1 | 2/2010 | Kato et al. | |
| 2011/0318047 | A1 * | 12/2011 | Nonaka | G03G 15/0225 399/100 |
| 2013/0089354 | A1 | 4/2013 | Kano et al. | |
| 2015/0277244 | A1 | 10/2015 | Sato et al. | |
| 2016/0154336 | A1 * | 6/2016 | Masu | G03G 15/0233 399/176 |
| 2016/0266511 | A1 * | 9/2016 | Kuroda | G03G 15/0233 |
| 2018/0275552 | A1 * | 9/2018 | Satoh | G03G 15/0233 |
| 2018/0364604 | A1 * | 12/2018 | Fujino | G03G 15/0233 |
| 2018/0364637 | A1 | 12/2018 | Kinokuni et al. | |

FOREIGN PATENT DOCUMENTS

| | | | |
|---|---|---|---|
| JP | 4101278 | B2 | 6/2008 |
| JP | 2013-065050 | A | 4/2013 |
| JP | 5871459 | B2 | 3/2016 |
| JP | 2016-184008 | A | 10/2016 |

* cited by examiner (a)

(b)

(a)

(b)

IMAGE FORMING APPARATUS AND CARTRIDGE HAVING A CHARGING ROLLER WITH A SURFACE LAYER INCLUDING PROJECTIONS

FIELD OF THE INVENTION AND RELATED ART

The present invention relates to an image forming apparatus, such as a copying machine, a printer or a facsimile machine, of an electrophotographic type, or an electrostatic recording type, and relates to a cartridge for use with the image forming apparatus.

Conventionally, for example, in the image forming apparatus of the electrophotographic type, as a type of electrically charging a photosensitive member (electrophotographic photosensitive member) as an image bearing member, a contact charging type in which the photosensitive member is charged under application of a voltage to a charging member contacted to the photosensitive member. As the charging member, a roller-shaped charging roller is used in many cases. The charging roller has, for example, a constitution in which an electroconductive elastic layer is provided on an outer peripheral surface of an electroconductive supporting member and on a surface of the electroconductive supporting member, an electroconductive surface layer is coated. In the contact charging type, the surface of the photosensitive member is charged by electric discharge (Paschen electric discharge) generating in a small gap between the photosensitive member and the charging member. The contact charging type includes an "AC charging type" in which a voltage in the form of a DC voltage biased with an AC voltage is applied to the charging member and a "DC charging type" in which only a DC voltage is applied to the charging member.

In the contact charging type, in the case where the charging roller is used for a long term, contaminants such as toner slipped through a cleaning blade for cleaning the surface of the photosensitive member and an external additive of the toner deposit on a surface of the charging member. Thus, when the contaminants deposit on the surface of the charging member, in some cases, a vertically stripe image defect (stripe image density non-uniformity generating at a position corresponding to a portion where the contaminants deposit on the surface of the charging member, with respect to a direction substantially perpendicular to a surface movement direction of the photosensitive member) or the like.

In order to suppress the deposition of the contaminant on the charging member, a decrease in contact area between the photosensitive member and the charging member in such a manner that a surface roughness of the charging member is increased is effective. Japanese Patent No. 4047057 discloses that particles are dispersed in a surface layer of the charging member.

Further, it is also effective to provide a means for removing the contaminant from the surface of the charging member. For example, a constitution in which a cleaning member formed with a cylindrical sponge is contacted to a surface of the charging member and the contaminant is removed from the surface of the charging member has been known. Japanese Patent No. 5871459 discloses a constitution in which a cleaning member formed by helically winding a strip of urethane sponge around a core metal is contacted to the surface of the charging member and thus the contaminant is removed from the surface of the charging member.

However, it turned out that when a cylindrical cleaning member is contacted to a surface of a charging member having a surface where projections are formed by dispersing particles in a surface layer, the contaminant is liable to deposit at base portions of the projections formed at the surface of the charging member. Further, it turned out that in the case where the charging member is used for a long term, the contaminant is liable to accumulate at the base portions of the projections formed at the surface of the charging member.

Further, it turned out that even in the case where the helical cleaning member is contacted to the surface of the charging member, as regards a charging member having a surface provided with projections formed in a predetermined size by dispersing particles of one kind in a surface layer, the contaminant is liable to deposit on a flat portion between projections of the surface of the charging member. Further, it turned out that in the case where the charging member is used for a long term, the contaminant is liable to accumulate at a flat portion of the surface of the charging member.

SUMMARY OF THE INVENTION

According to an aspect of the present invention, there is provided an image forming apparatus comprising: a photosensitive member; a charging roller contacting the photosensitive member and configured to electrically charge the photosensitive member by being supplied with a voltage, wherein the charging roller has an outermost surface layer including an electroconductive resin material, first surface particles having an average particle size of more than 7 μm and less than 30 μm and second surface particles having an average particle size of more than 2 μm and less than 6 μm, and wherein the first surface particles and the second surface particles are dispersed in the electroconductive resin material so as to form first projections and second projections, respectively, on a surface of the charging roller; a cleaning roller contacting the charging roller and configured to clean a surface of the charging roller, wherein the cleaning roller includes a shaft portion and an elastic cleaning portion extending helically around the shaft portion and having a rectangular cross-section perpendicular to an extending direction thereof; an urging member configured to urge the cleaning roller against the charging roller; and an image forming portion configured to form a toner image on the photosensitive member charged by the charging roller and configured to transfer the toner image onto a recording material.

According to another aspect of the present invention, there is provided a cartridge detachably mountable to an image forming apparatus, the cartridge comprising: a photosensitive member; a charging roller contacting the photosensitive member and configured to electrically charge the photosensitive member by being supplied with a voltage, wherein the charging roller has an outermost surface layer including an electroconductive resin material, first surface particles having an average particle size of more than 7 μm and less than 30 μm and second surface particles having an average particle size of more than 2 μm and less than 6 μm, and wherein the first surface particles and the second surface particles are dispersed in the electroconductive resin material so as to form first projections and second projections, respectively, on a surface of the charging roller; a cleaning roller contacting the charging roller and configured to clean a surface of the charging roller, wherein the cleaning roller includes a shaft portion and an elastic cleaning portion extending helically around the shaft portion and having a rectangular cross-section perpendicular to an extending direction thereof; and an urging member configured to urge the cleaning roller against the charging roller.

Further features of the present invention will become apparent from the following description of exemplary embodiments with reference to the attached drawings.

Figure 3:
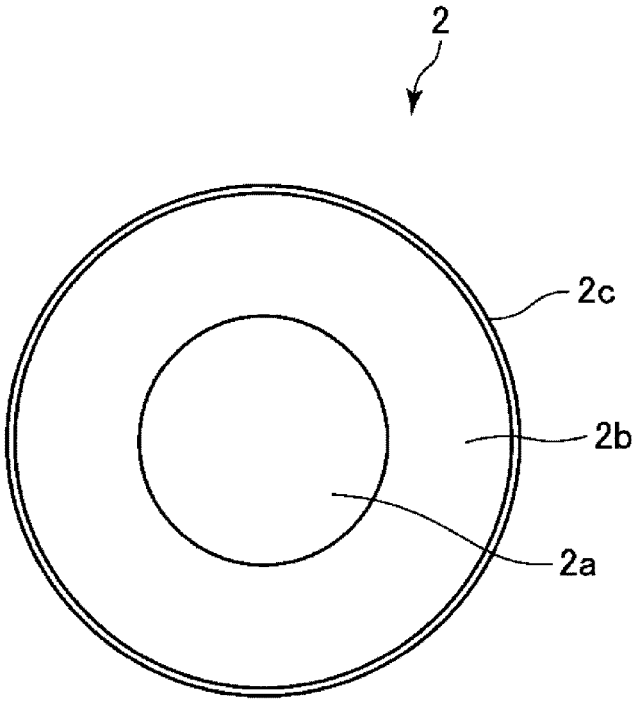
Figure 3:
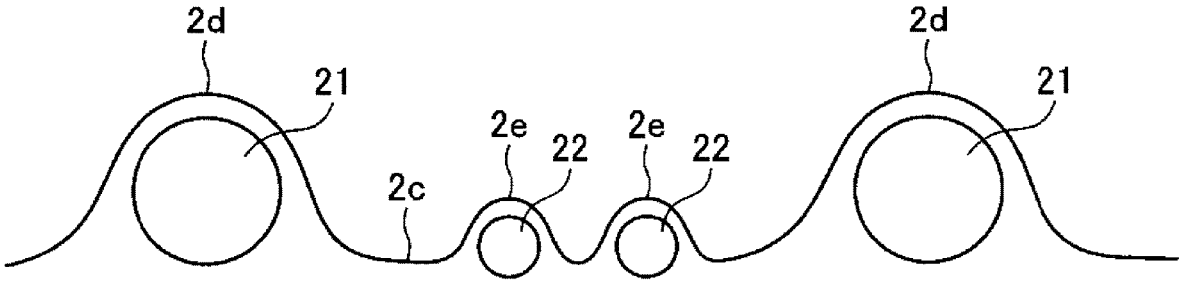

Parts (a) and (b) of FIG. 3 are schematic sectional views of a charging roller and a surface layer of the charging roller, respectively.

Figure 4:
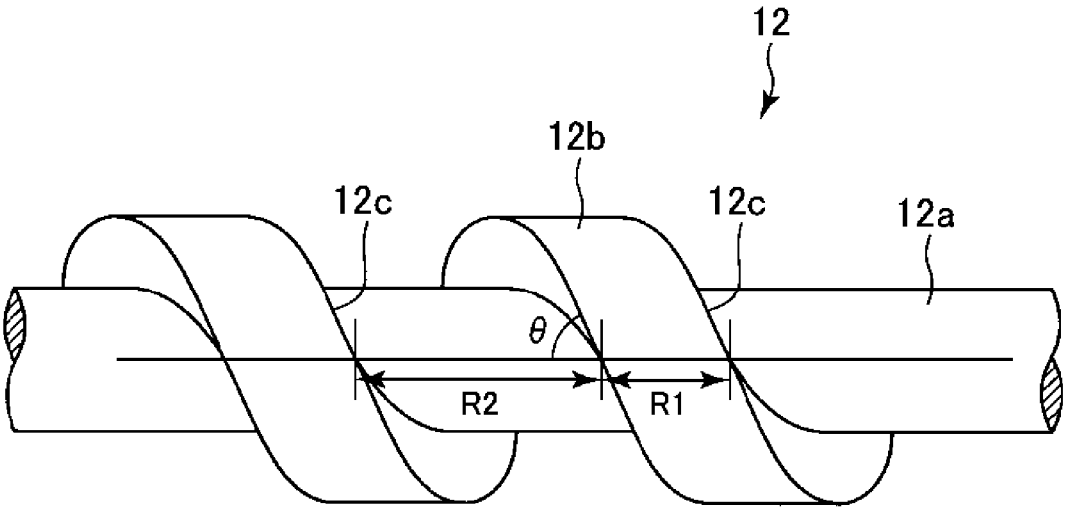
Figure 4:
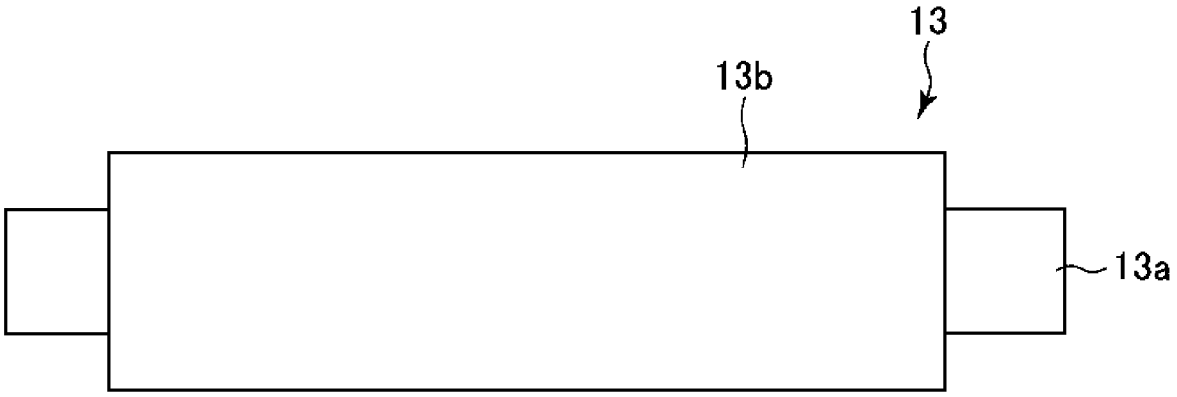

Parts (a) and (b) of FIG. 4 are schematic side views of cleaning members in Embodiment 1 and a comparison example, respectively.

Figure 5:
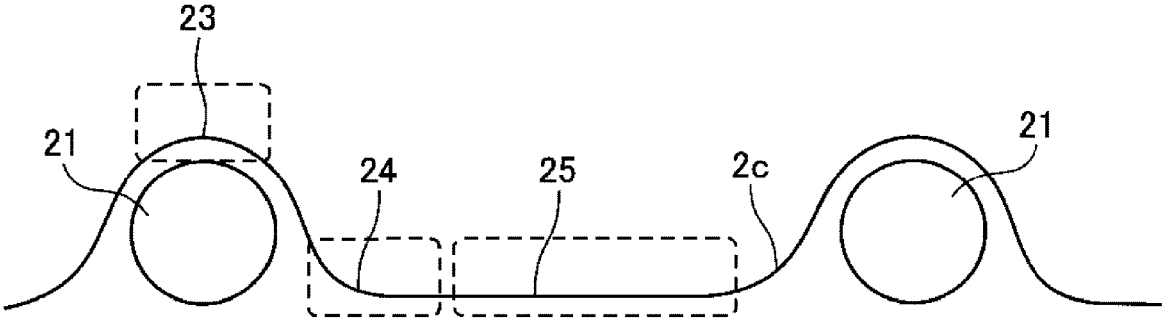

FIG. 5 is a schematic view for illustrating a mechanism of contamination of a charging roller.

Figure 6:
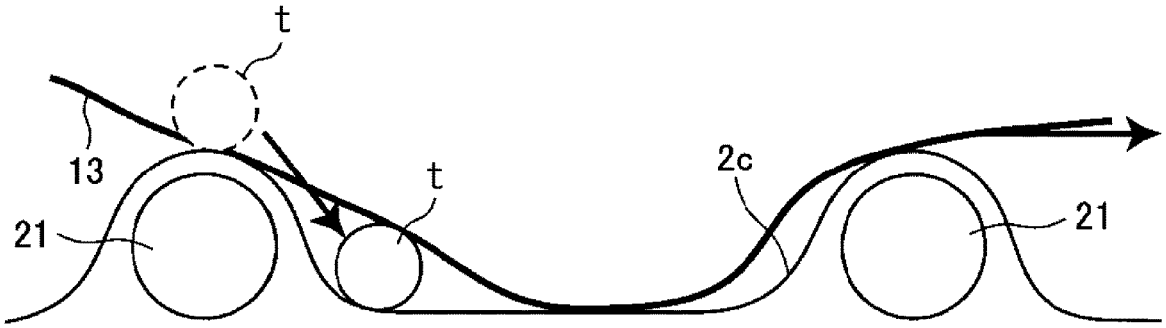

FIG. 6 is a schematic view for illustrating an evaluation result of Comparison Example 1.

Figure 7:
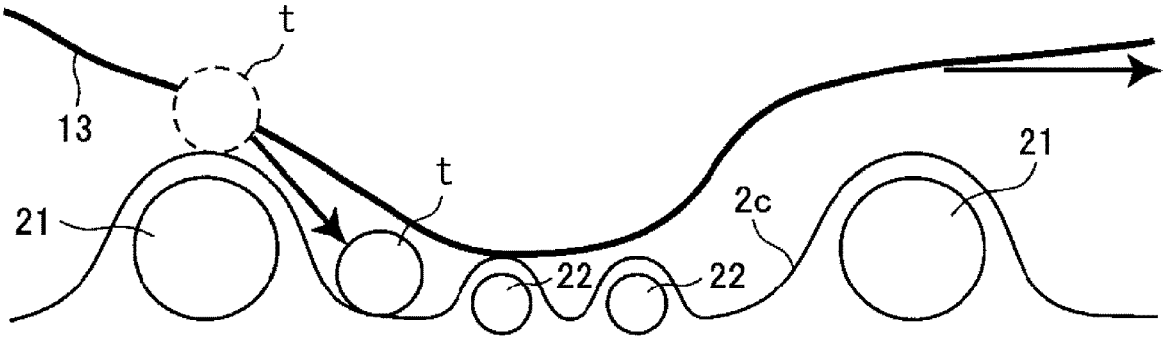

FIG. 7 is a schematic view for illustrating an evaluation result of Comparison Example 2.

Figure 8:
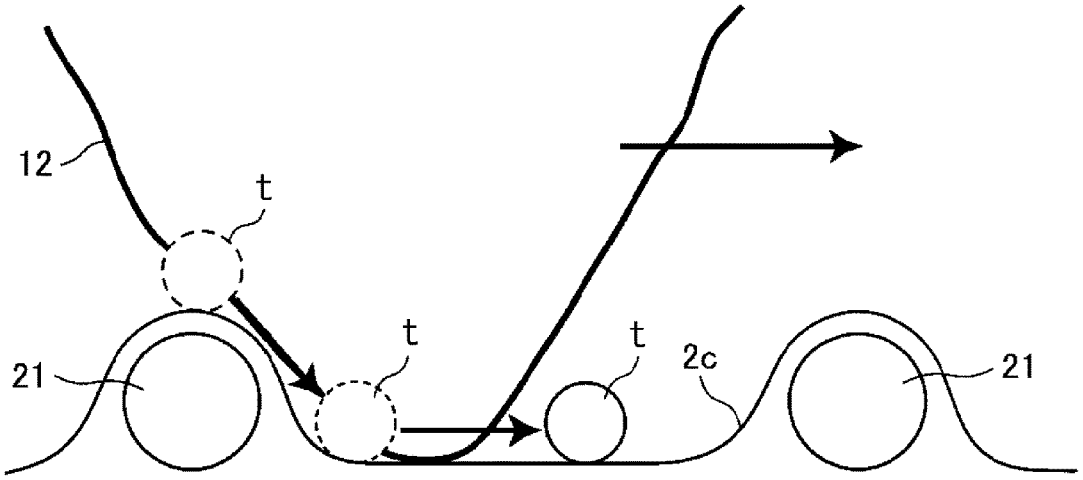

FIG. 8 is a schematic view for illustrating an evaluation result of Comparison Example 3.

Figure 9:
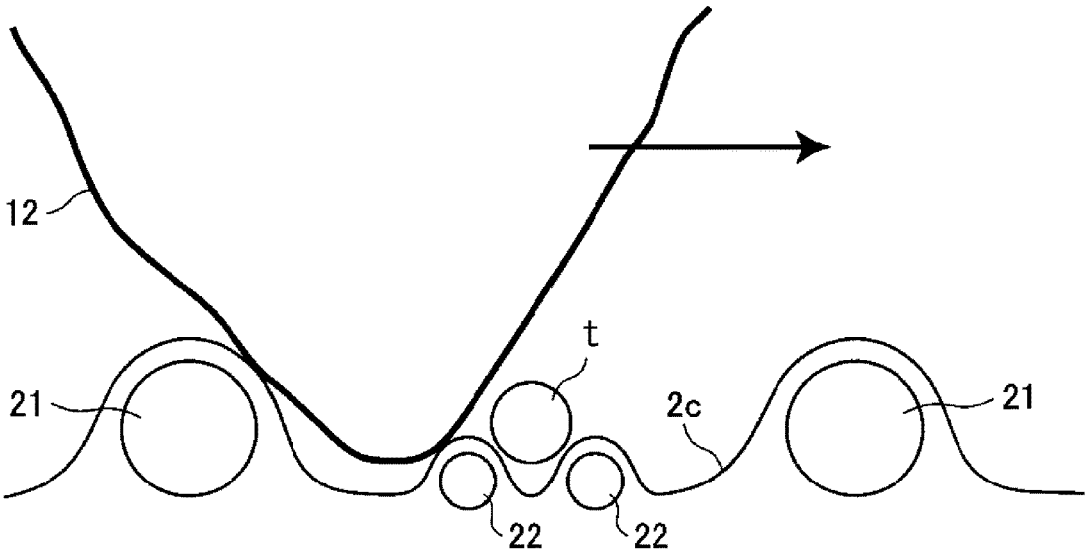

FIG. 9 is a schematic view for illustrating an evaluation result of Embodiment 1.

Figure 10:
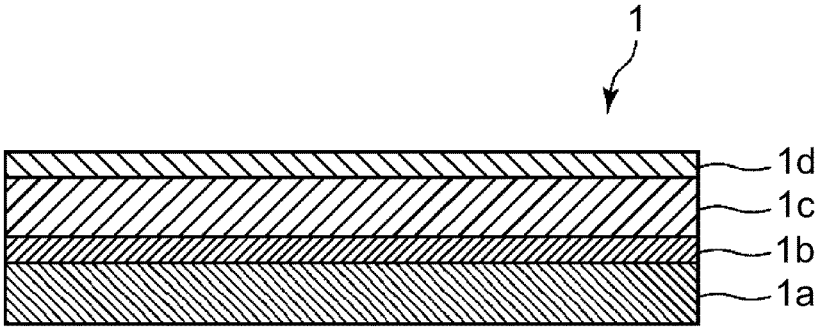

FIG. 10 is a schematic sectional view of a photosensitive drum.

Figure 11:
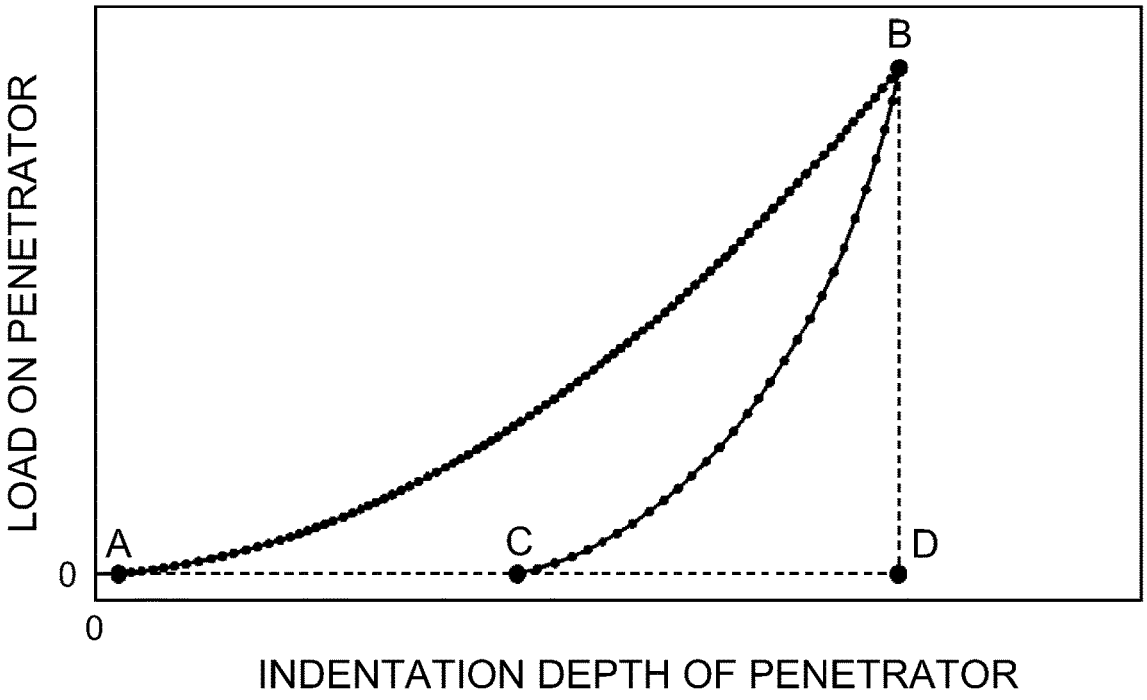

FIG. 11 is a graph for illustrating a measuring method of elastic deformation rate.

Figure 12:
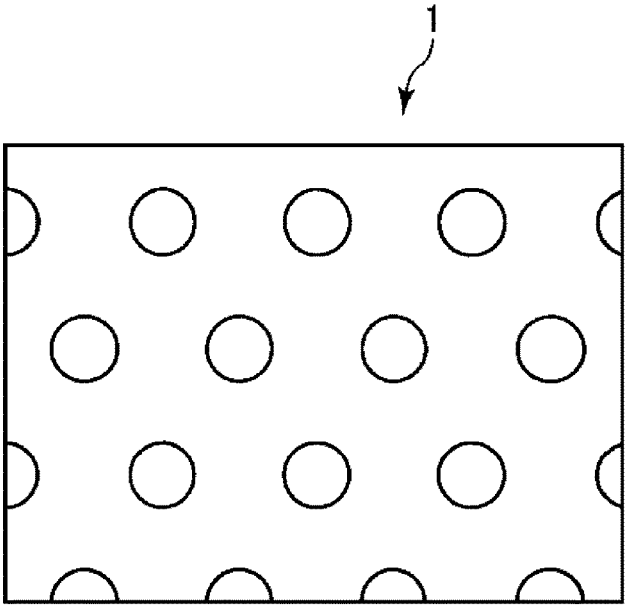

FIG. 12 is a schematic view of recesses formed on a surface of a photosensitive drum.

DESCRIPTION OF THE EMBODIMENTS

An image forming apparatus and a cartridge, which are in accordance with the present invention will be described with reference to the drawings.

Embodiment 1

1. General Constitution and Operation of Image Forming Apparatus

Figure 1:
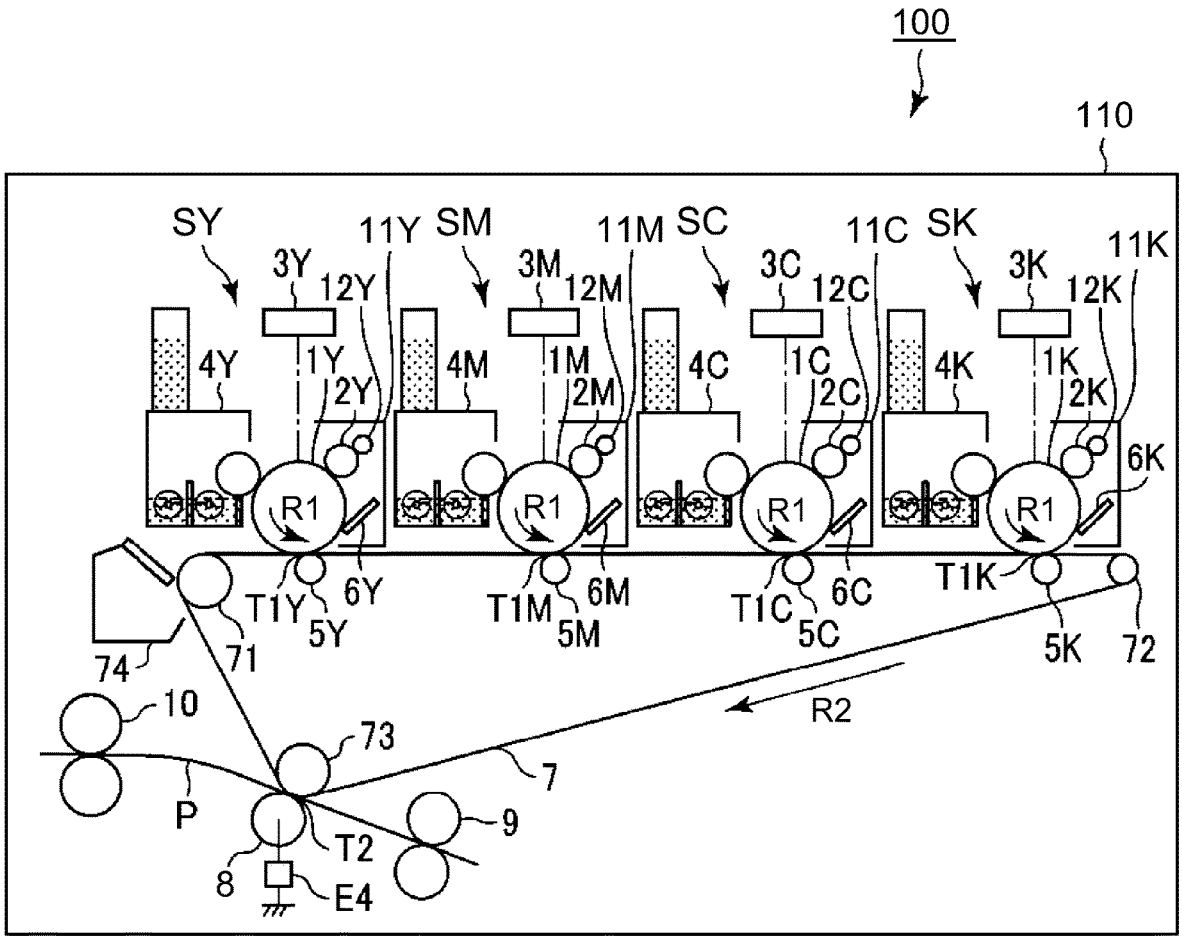
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type (in-line-type) multi-function machine, having functions of a copying machine, a printer and a facsimile apparatus, employing an intermediary transfer type capable of forming a full-color image by using an electrophotographic type. The image forming apparatus 100 of this embodiment employs a contact charging type, particularly a DC charging type and is capable of forming an image on an A3-size transfer(-receiving material) to the maximum.

Figure 2:
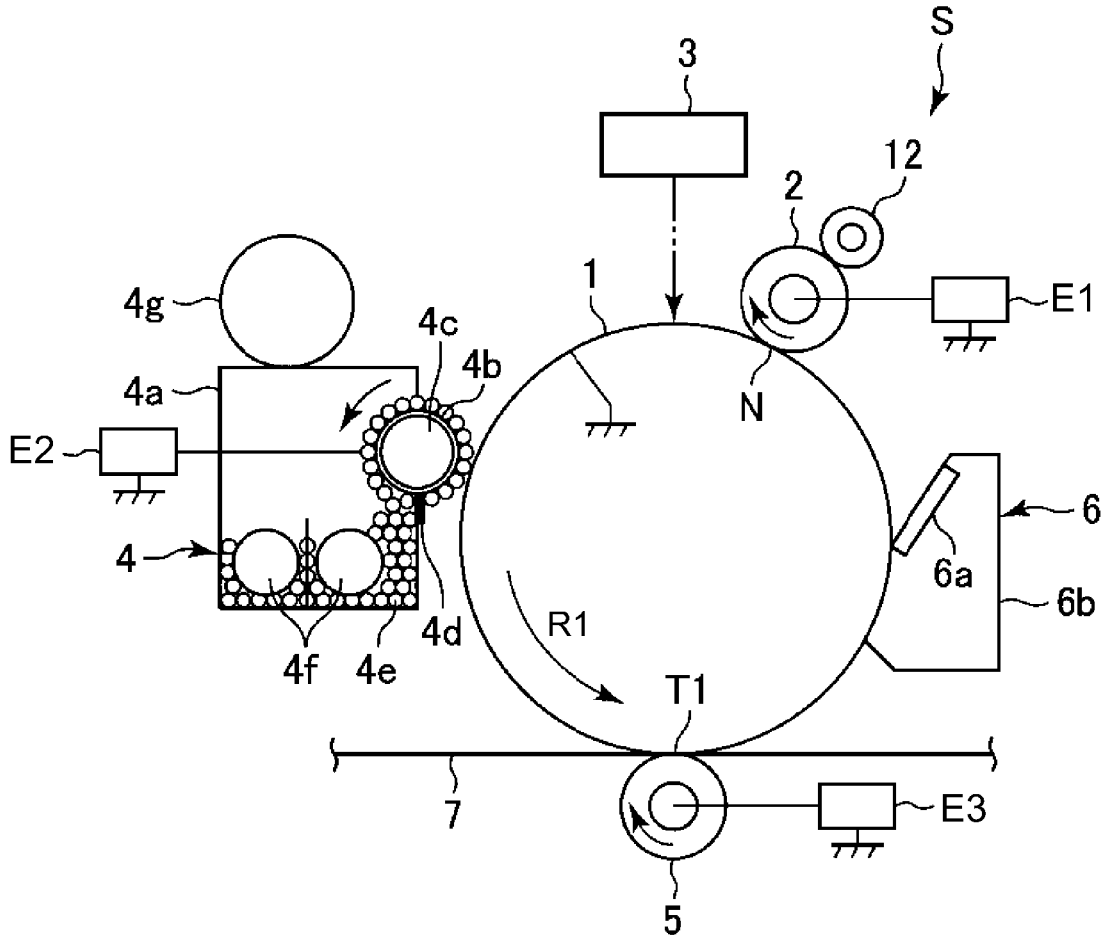
FIG. 2 is a schematic sectional view showing an image forming portion.

The image forming apparatus 100 includes, as a plurality of image forming portions, first to fourth image forming portions SY, SM, SC and SK for forming images of yellow (Y), magenta (M), cyan (C) and black (K), respectively. Incidentally, elements having the same or corresponding functions and constitutions in the respective image forming portions SY, SM, SC and SK are collectively described by omitting suffixes Y, M, C and K for representing elements for associated colors in some cases. FIG. 2 is a schematic sectional view showing a single image forming portion S as a representative. In this embodiment, the image forming portion S is constituted by including a photosensitive drum 1, a charging roller 2, a cleaning member 12, an exposure device 3, a developing device 4, a primary transfer roller 5, a drum cleaning device 6, and the like, which are described later.

The image forming apparatus 100 includes the photosensitive drum 1 which is a rotatable drum-shaped (cylindrical) photosensitive member as an image bearing member.

The photosensitive drum 1 is rotationally driven in an indicated arrow R1 direction at a predetermined peripheral speed (process speed) by a driving motor (not shown) as a driving means. In this embodiment, the photosensitive drum 1 is a negatively chargeable drum-shaped organic photosensitive member and is constituted by forming a photosensitive layer (OPC layer) on a substrate formed of an electroconductive material such as aluminum. A surface of the rotating photosensitive drum 1 is electrically charged uniformly to a predetermined polarity (negative in this embodiment) and a predetermined potential by the charging roller 2 which is a roller-type charging member as a charging means. During a charging step, to the charging roller 2, from a charging voltage source (high-voltage source circuit) E1 as an applying means, a charging voltage (charging bias) consisting only of a DC voltage (DC component) is applied. A charging process of a surface of the photosensitive drum 1 is carried out by electric discharge generating in at least one of minute gaps between the photosensitive drum 1 and the charging roller 2 on upstream and downstream sides of a contact portion N between the photosensitive drum 1 and the charging roller 2 with respect to a rotational direction of the photosensitive drum 1. The charged surface of the photosensitive drum 1 is subjected to scanning exposure to light by the exposure device 3 as an exposure means (electrostatic image forming means), so that an electrostatic image (electrostatic latent image) is formed on the photosensitive drum 1. In this embodiment, the exposure device 3 is a laser beam scanner using a semiconductor laser. As a charging member cleaning member, a helical cleaning member 12 is provided so as to contact the surface of the charging roller 2. The surface of the charging roller 2 is cleaned by the helical cleaning member 12.

The electrostatic image formed on the photosensitive drum 1 is developed (visualized) with a developer by the developing device 4, so that a toner image is formed on the photosensitive drum 1. In this embodiment, toner charged to the same polarity as a charge polarity (negative polarity in this embodiment) of the photosensitive drum 1 is deposited on an exposed portion, on the photosensitive drum 1, where an absolute value of a potential is lowered by subjecting the surface of the photosensitive drum 1 to the exposure to the laser beam after uniformly charging the surface of the photosensitive drum 1. That is, in this embodiment, a normal toner charge polarity which is the toner charge polarity during development is the negative polarity. In this embodiment, the developing device 4 uses a two-component developer containing toner (non-magnetic toner particles) as the developer and a carrier (magnetic carrier particles). The developing device 4 includes a developing container **4*a* accommodating a developer 4*e* and a developing sleeve 4*b* provided rotatably to the developing container 4*a* so as to be partly exposed toward an outside through an opening of the developer container 4*a* and formed with a non-magnetic hollow cylindrical member. Inside (at a hollow portion of) the developing sleeve 4*b*, a magnet roller 4*c* is provided fixedly to the developing container 4*a*. The developing container 4***a* is provided with a regulating blade 4*d* so as to oppose the developing sleeve 4*b*. In the developing container 4*a*, two stirring members (stirring screws) 4*f* are provided. Into the developing container 4*a*, the toner is appropriately supplied from a toner hopper 4*g*. The developer 4*e* carried on the developing sleeve by a magnetic force of the magnet roller 4*c* is fed to an opposing portion (developing portion) to the photosensitive drum 1 after an amount thereof is regulated by the regulating blade 4*d* with rotation of the developing sleeve 4*b*. The developer on the developing sleeve 4*b* fed to the developing portion erected by the magnetic force of the magnet roller 4*c* and forms a magnetic brush (magnetic chain), so that the developer is contacted to or brought near to the surface of the photosensitive drum 1. During the development, to the developing sleeve 4*b*, from a developing voltage source (high-voltage source circuit) E2, as a developing voltage (developing bias), an oscillating voltage in the form of a DC voltage (DC component) biased with an AC voltage (AC component) is applied. As a result, depending on the electrostatic image on the photosensitive drum 1, the toner is moved from the magnetic brush on the developing sleeve 4*b* onto the photosensitive drum 1, so that the toner image is formed on the photosensitive drum 1.

An intermediary transfer belt 7 constituted by an endless belt as an intermediary transfer member is provided so as to oppose the respective photosensitive drums 1. The intermediary transfer belt 7 is extended around a driving roller 71, a tension roller 72 and a secondary transfer opposite roller 73 which are used as stretching rollers, and is stretched with a predetermined tension. The intermediary transfer belt 7 is rotated (circulated) by rotationally driving the driving roller 71 in an indicated arrow R2 direction at a peripheral speed (process speed) substantially equal to the peripheral speed of the photosensitive drum 1. In an inner peripheral surface side of the intermediary transfer belt 7, a primary transfer roller 5 which is a roller-type primary transfer member as a primary transfer means is provided corresponding to the associated photosensitive drum 1. The primary transfer roller 5 is pressed (urged) against the intermediary transfer belt 7 toward the photosensitive drum 1, so that a primary transfer portion (primary transfer nip) T1 where the photosensitive drum 1 and the intermediary transfer belt 7 contact each other is formed.

The toner image formed on the photosensitive drum 1 is primary-transferred by the action of the primary transfer roller 5 onto the intermediary transfer belt 7 at the primary transfer portion T1. During a primary transfer step, to the primary transfer roller 5, a primary transfer voltage (primary transfer bias) which is a DC voltage of an opposite polarity to the normal charge polarity of the toner is applied from a primary transfer voltage source (high-voltage source circuit) E3. For example, during full-color image formation, the respective color toner images of yellow, magenta, cyan and black formed on the respective photosensitive drums 1 are successively transferred superposedly onto the intermediary transfer belt 7.

At a position opposing the secondary transfer opposite roller 73 on an outer peripheral surface side of the intermediary transfer belt 7, a secondary transfer roller 8 which is a roller-type secondary transfer member as a secondary transfer means is provided. The secondary transfer roller 8 is pressed (urged) against the intermediary transfer belt 7 toward the secondary transfer opposite roller 73 and forms a secondary transfer portion (secondary transfer nip) T2 where the intermediary transfer belt 7 and the secondary transfer roller 8 are in contact with each other. The toner images formed on the intermediary transfer belt 7 as described above secondary-transferred by the action of the secondary transfer roller 8 onto a transfer(-receiving) material (sheet, recording material) P, such as a recording sheet, nipped and fed at the secondary transfer portion T2 by the intermediary transfer belt 7 and the secondary transfer roller 8. During a secondary transfer step, to the secondary transfer roller 8, a secondary transfer voltage (secondary transfer bias) which is a DC voltage of an opposite polarity to the normal charge polarity of the toner is applied from a secondary transfer voltage source (high-voltage source circuit) E4. The transfer material P is fed one by one by a feeding device (not shown) and then is conveyed to a registration roller pair 9, and thereafter, the transfer material P is timed to the toner images on the intermediary transfer belt 7 and then is supplied to the secondary transfer portion T2 by the registration roller pair 9. Further, the transfer material P on which the toner images are transferred is fed to a fixing device 10 and is heated and pressed by the fixing device 10, so that the toner images are fixed (melt-fixed) on the transfer material P. Thereafter, the transfer material P on which the toner images are fixed is discharged (outputted) to an outside of the apparatus main assembly 110 of the image forming apparatus 100.

On the other hand, toner (primary transfer residual toner) remaining on the photosensitive drum 1 during the primary transfer is removed and collected from the surface of the photosensitive drum 1 by a drum cleaning device 6 as a photosensitive member cleaning means. The drum cleaning device 6 includes a cleaning blade 6*a* as a cleaning member and includes a cleaning container 6*b*. The drum cleaning device 6 rubs the surface of the rotating photosensitive drum 1 with the cleaning blade 6*a*. As a result, the primary transfer residual toner on the photosensitive drum 1 is scraped off the surface of the photosensitive drum 1 and is accommodated in the cleaning container 6*b*. Further, on an outer peripheral surface side of the intermediary transfer belt 7, a belt cleaning device 74 as an intermediary transfer member cleaning means is provided at a position opposing the driving roller 71. Toner (secondary transfer residual toner) remaining on the surface of the intermediary transfer belt 7 during a secondary transfer step is removed and collected from the surface of the intermediary transfer belt 7 by the belt cleaning device 74.

In this embodiment, at each of the image forming portions S, the photosensitive drum 1, the charging roller 2, the helical cleaning member 12 and the drum cleaning device 6 integrally constitute a cartridge (drum cartridge) 11 detachably mountable to the apparatus main assembly 110.

2. Charging Member and Helical Cleaning Member

<Charging Member>

Part (a) of FIG. 3 is a schematic sectional view showing a layer structure of the charging roller 2 in this embodiment. The charging roller 2 includes a supporting member (electroconductive supporting member, core metal) 2*a*, a base layer (electroconductive elastic layer) 2*b* formed on an outer peripheral surface of the supporting member 2*a*, and a surface layer (outermost layer) 2*c* formed on the base layer 2*b*. The charging roller 2 is rotatably supported by bearing members 2*e* at end portions of the supporting member 2*a* with respect to a rotational axis direction. Further, the charging roller 2 is urged against the surface of the photosensitive drum 1 with a predetermined urging force by urging of the bearing members, provided at the end portions of the supporting member 2*a* with respect to the rotational axis direction, by urging springs, respectively as urging means. The charging roller 2 is rotated by rotation of the photosensitive drum 1.

The supporting member 2*a* is a shaft made of metal (chromium-plated iron) in this embodiment. The base layer 2*b* can be formed with a rubber, thermoplastic elastomer or the like suitable as a material of the base layer of the charging member. Specifically, the base layer 2*b* can be formed using a hydrin-based rubber material (epichlorohydrin) or an urethane-based rubber material (polyurethane). Further, the surface layer 2*c* can be formed of a resin material suitable as a material for forming the surface of the charging member. Specifically, the surface layer 2*c* can be formed using an acrylic resin material or a nylon-based resin material. The surface layer 2*c* imparts an anti-wearing (abrasion) property against the photosensitive drum 1 to the charging roller 2. In addition, the surface layer 2*c* has a function of suppressing leakage of a current in the case where a pinhole generates on the photosensitive drum 1 and has a function of suppressing contamination of the charging roller 2 with the toner or an external additive externally added to the toner. Particularly, in this embodiment, the base layer 2*b* is formed using a hydrin rubber-based material, and the surface layer 2*c* is formed using a nylon (resin material)-based material. Incidentally, electroconductivity can be imparted to or adjusted for the base layer 2*b* and the surface layer 2*c* by adding an electroconductive agent.

Part (b) of FIG. 3 is a schematic enlarged view of the surface layer 2*c*. In the material forming the surface layer 2*c*, first surface (layer) particles ("large particles") 21 and second surface (layer) particles ("small particles") 22 having a particle size smaller than a particle size of the first surface particles 21 are dispersed. As the first and second surface particles 21 and 22 added (contained) in the electroconductive resin layer forming the surface layer 2*c*, organic particles or inorganic particles which are insulating particles ($10^{10}$ Ω·cm or more) other than the above-described electroconductive agents can be used. As the organic particles, particles of acrylic resin material, acryl-styrene copolymer resin material, polyamide resin material, silicone rubber, epoxy resin material and the like can be cited. Of these particles, it is particularly preferable that the particles of acrylic resin material or acryl-styrene copolymer resin material is used since rigidity of the material is not so changed. As the inorganic particles, for example, particles of calcium carbonate, clay, talc, silica and the like can be cited. Incidentally, in the case where the inorganic particles are used in a solvent-based paint, it is preferable that the inorganic particles are subjected to hydrophobic surface treatment so as to be easily dispersed in the paint. Further, also as regards the organic particles, similarly, organic particles having a good compatibility with the resin material of the surface layer 2*c* may preferably be selected since the particles do not readily cause agglomeration. In this embodiment, a surface shape of the charging roller 2 is formed by the first and second surface particles 21 and 22 so that relatively large first projections (projected portions) 2*d* (having a large height on a base layer basis) and relatively small second projections (projected portions) 2*e* (having a small height on the base layer basis) are used in combination.

A forming method of the surface layer 2*c* is not particularly limited, but a method in which a paint containing respective ingredients is prepared and is coated on the base layer 2*b* by dipping or spray coating and thus a pint film is formed may preferably be used. In this embodiment, the first and second surface particles 21 and 22 were mixed and dispersed in the resin material forming the surface layer 2*c* and the mixture was coated on the surface of the base layer 2*b* by spray coating, so that the surface layer 2*c* including a plurality of first projections 2*d* and a plurality of second projections 2*e* was formed.

An average particle size of the first surface particles 21 may desirably be not less than an average particle size of the toner. For that reason, in this embodiment, the first surface particles 21 was 15 μm. With an increasing average particle size of 20 μm and 25 μm of the first surface particles 21, there is a tendency that contaminants such as the toner and the external additive do not readily deposit on the charging roller 2. However, when the average particle size of the first surface particles 21 is excessively large, particularly in the DC charging type, a degree of half-tone roughness becomes worse due to local electric discharge. Incidentally, in this embodiment, the average particle size of the toner is about 6 μm. On the other hand, the average particle size of the second surface particles 22 is required to be smaller than the average particle size of the first surface particles 21 and can be made approximately the same as the average particle size of the toner. However, even when the average particle size of the second surface particles 22 is excessively small, a degree of dispersibility of the second surface particles 22 becomes worse and an aggregate of the second surface particles 22 is liable to generate, and thus the degree of the half-tone roughness becomes worse in some cases similarly as described above. For that reason, in this embodiment, the average particle size of the second surface particles 22 was 5 μm. Incidentally, the projection 2*e* smaller in average particle size than the toner particle may desirably be disposed between adjacent projections 2*d* larger in average particle size than the toner particle at the surface of the charging roller 2. As a result, as described specifically lager, the contaminant deposited on the first projections 2*d* formed by the large particles 21 is easily moved between the first projections 2*d*, so that the contaminant is easily removed from the surface of the charging roller 2.

The average particle sizes of the first and second surface particles 21 and 22 are not limited to those described in this embodiment, but can be appropriately selected from the above-described viewpoints, respectively. Of the average particle sizes of a plurality of kinds of surface particles different in particle size, the average particle size (average diameter) of the first surface particles ("large particle") 21 having the relatively large particle size is D1, and the average particle size of the second surface particles ("small particles") 22 having the relatively small particle size is D2. In this case, typically, these average particle sizes D1 and D2 may preferably fall under the following ranges:

$7\ \mu m < D1 < 30\ \mu m$ and $2\ \mu m < D2 < 6\ \mu m$.

As a result, not only worsening in degree of the half-tone roughness due to the excessively large particle size of the surface particles (particularly, the "large particles") can be suppressed, but also the generation of the aggregate of the surface particles due to the excessively small particle size of the surface particles (particularly, the "small particles") can be suppressed. Further, by combining the plurality of kinds of the surface particles different in particle size, as specifically described later, a depositing force of the contaminant on the surface of the charging roller 2 can be reduced by the second projections 2*e* formed by the small particles 22 between the first projections 2*d* formed by the large particles 21. Further, particularly in the DC charging type, only by the large particles, the degree of the half-tone roughness becomes worse, but by combining the large particles with the small particles, the local electric discharge is alleviated, so that the degree of the half-tone roughness is improved.

Incidentally, the average particle sizes of the first and second surface particles 21 and 22 are center particle sizes and can be measured by the following method. As a measuring device, a Coulter Counter ("Multisizer type II", mfd. by Beckman Coulter Inc.) is used. Further, an interface (mfd. by Nikkaki Bios Co., Ltd.) and a personal computer ("CX-I", mfd. by Canon K.K.) for outputting the number and volume average distributions of the particles are connected with the Coulter Counter. As an electrolytic aqueous solution, 1% NaCl aqueous solution prepared by using a first class grade sodium chloride is prepared. As a measuring method, 0.1-5 ml of a surfactant, preferably alkyl-benzene sulfonate, is added, as dispersant, into 100-150 ml of above-mentioned electrolytic aqueous solution. Then, 2-20 mg of a measuring sample is added to the above mixture. Then, the electrolytic aqueous solution in which the sample is suspended is subjected to dispersion by an ultrasonic dispersing device for about 1-3 minutes. Then, the particle size distribution of the particles which were in a range of 2-40 μm in diameter was obtained with the use of the Coulter Counter (Multisizer type II) fitted with a 100 μm aperture as an aperture. A volume and the number of particles subjected to the measurement are measured, so that a volume distribution and a number distribution are calculation. Then, a particle size $D_{50}$ corresponding to a volume-bias particle distribution can be used as the center particle size which is the average particle size.

Here, as described specifically later, when an interval between the large particles 21 is about 5-50 μm, an edge portion of the helical cleaning member 12 does not readily enter between the large particles 21, and therefore, the interval (distance) between the large particles 21 may desirably be 100 μm or more. Further, when the interval between the large particles 21 exceeds 600 μm, the interval between the large particles 21 is excessively broad and the contaminant is liable to deposit on the surface of the charging roller 2, and therefore, the interval between the large particles 21 may desirably be 600 μm or less. That is, an average interval Sm between the first projections 2*d* at the surface of the charging roller 2 may preferably be 0.1 mm or more and 0.6 mm or less. This average interval Sm of the first projections 2*d* can be acquired by measuring a surface shape of the charging roller 2 in which only the large particles in an amount substantially equal to an amount in the case where the large particles 21 and the small particles are dispersed in the surface layer 2*c* are dispersed in the surface layer 2*c*. Further, it is desirable that with respect to a single large particle 21, about 10-50 small particles 22, preferably about 30-50 small particles are placed between the large particles 21 on a particle amount basis. That is, when the number of the first surface particles 21 is A and the number of the second surface particles 22 is B, the numbers A and B satisfy A:B=1:10 to 50, preferably A:B=1:30 to 50. As a result, the small particles 22 are disposed sufficiently between the large particles 21, so that as described specifically later, not only the depositing force of the contaminant on the surface of the charging roller 2 can be sufficiently decreased, but also the generation of the aggregate due to the excessive amount of the small particles 22 can be suppressed. Further, a ten point average roughness Rz of the surface of the charging roller 2 may preferably be 6 μm or more and about 30 μm or less. As a result, not only the deposition of the contaminant on the surface of the charging roller 2 due to an excessive degree of smoothness of the surface of the charging roller 2 can be suppressed, but also the worsening of the degree of the half-tone roughness of the surface shape of the charging roller 2 can be suppressed. Further, typically, a thickness (film thickness) of the surface layer 2*c* is about 4 or more and about 30 μm or less.

In this embodiment, the ten point average roughness Rz is 12 μm, the average interval Sm of the first projections 2*d* is 100 μm (=0.1 mm).

Incidentally, the ten point average roughness Rz and the average interval Sm were measured in the following manner in accordance with JIS B0601 ('82) in which a rotational axis direction of the charging roller 2 was taken as a measuring direction. As a measuring device, a surface roughness meter (equivalent for "Surfcom 480", manufactured by Tokyo Seimitsu Co., Ltd.) was used. A measuring point is a single point of the surface of the charging roller 2 at a substantially central portion with respect to the rotational axis direction. A longitudinal magnification was 2000, and a lateral magnification was 50. A measuring condition was 0.8 mm in cut-off δc, 4.0 mm in measuring length, and 0.3 mm/s is feeding speed. In this measurement, average values of the ten point average roughness Rz and the average interval Sm measured at a plurality of points of the surface of the charging roller 2, for example, 3 points with respect to the longitudinal direction and 3 points with respect to a circumferential direction (every 120° with an arbitrary place as a starting point) of the charging roller 2 were substantially the same as those (measured values) at the above-described single point. However, in the case where the values of Rz and Sm cause a variation among the measuring points, the values of Rz and Sm can be represented by the average values.

Incidentally, in order to use charging roller in comparison examples (Comparison Examples 1, 3 and 4) described later, a charging roller 2 having a surface shape (Rz=12 μm, Sm=100 μm (=0.1 mm)) was also prepared by dispersing only the first surface particles ("large particles") 21 (average particle size: 15 μm) in the surface layer 2*c*.

<Helical Cleaning Member>

Part (a) of FIG. 4 is a side view of a part of the helical cleaning member 12 in this embodiment. The helical cleaning member 12 is constituted by including a shaft portion 12*a* and a cleaning portion 12*b* fixed to an outer peripheral surface of the shaft portion 12*a* by being helically wound around the outer peripheral surface of the shaft portion 12*a*. The shaft portion is a metal shaft of 6 mm in outer diameter in this embodiment. The cleaning portion 12*b* is formed with an urethane sponge (polyurethane foam) which is an elastic foam as an elastic material in this embodiment, and a strip of elongated rectangular material which has a rectangular cross-section substantially perpendicular to the longitudinal direction and which extends in one direction in a state before the cleaning portion 12*b* is wound around the shaft portion 2*a*. In this embodiment, this urethane sponge is 70 kg/m$^3$ in density, 313.8 N in hardness, and 80 particles/25 mm in cell density. In this embodiment, the helical cleaning member 12 was prepared in the following manner. An urethane sponge material (sheet) is cut in a strip of elongated material having a width (length with respect to a direction substantially perpendicular to the longitudinal direction) of 8 mm and a thickness of 2.35 mm, so that a strip of the cleaning portion 12*b* before being wound around the shaft portion 12*a* is prepared. Onto one surface of the strip of the cleaning portion 12*b* with respect to the thickness direction, a fixing means such as an adhesive, a tackifier or a double-side tape is applied. Then, this strip of the cleaning portion 12*b* is fixed to the outer peripheral surface of the shaft portion 12*a* by being helically wound around the outer peripheral surface of the shaft portion 12*a* in a manner such that its surface onto which the fixing means is applied is oriented to the surface of the shaft portion 12*a* and the cleaning portion 12*b* is wound around the surface of the shaft portion 12*a* in a winding direction with a winding angle of 26° which is an inclination angle with respect to an axial direction of the shaft portion 12*a*, without applying a tensile force. At this time, in this embodiment, the shaft portion 12*a* is rotated at a substantially certain speed, so that the cleaning portion 12*b* is wound around the outer peripheral surface of the shaft portion 12*a*.

Here, a coverage ratio (%) of the helical cleaning member 12 showing a ratio in which the outer peripheral surface of the shaft portion 12*a* is coated with the cleaning portion 12*b* is acquired by the following equation:

$$\text{Coverage ratio (\%)}=\{(\text{helical width } R1)/(\text{helical width } R1)+(\text{helical interval } R2)\}\times 100.$$

In this equation, the helical width R1 is a width, with respect to the direction substantially parallel to the axial direction of the shaft portion 12*a* of the cleaning portion 12*b* in a state in which the cleaning portion 12*b* is wound around the shaft portion 12*a*. Further, the helical interval R2 is a distance (interval), with respect to the direction substantially parallel to the axial direction of the shaft portion 12*a*, between adjacent portions of the cleaning portion 12*b* in the state in which the cleaning portion 12*b* is wound around the shaft portion 12*a*. In this case, in this embodiment, the coverage ratio of the helical cleaning member 12 is about 60%. The coverage ratio in which the shaft portion 12*a* is covered with the cleaning portion 12*b* may preferably be 40% or more and 90% or less. When the coverage ratio is smaller than 40%, the number of times of contact between the surface of the charging roller 2 and the edge portion of the cleaning portion 12*b* is excessively decreased, so that cleaning power in which the charging roller 2 is cleaned by the helical cleaning member 12 lowers. Further, when the coverage ratio is larger than 90%, a following property of the cleaning portion 12*b* to the surface shape of the charging roller 2 lowers, so that the cleaning power in which the charging roller 2 is cleaned by the helical cleaning member 12 lowers.

The helical cleaning member 12 is rotatably held by bearing members at end portions of the shaft portion 12*a* with respect to the axial direction, and the bearing members are urged in a rotation center direction of the charging roller 2 by urging springs, respectively, as urging means, so that the helical cleaning member 12 is contacted to the surface of the charging roller 2. In this embodiment, at the end portions, the bearing members are urged toward the charging roller 2 by the urging springs each under a load of 200 gf. Then, the helical cleaning member 12 is rotated by rotation of the charging roller 2. Incidentally, the helical cleaning member 12 may also be independently rotationally driven.

The helical cleaning member 12 forms a nip by contact between principally an edge portion 12*c* of an end portion of the cleaning portion 12*b*, with respect to a widthwise direction substantially parallel to the axial direction of the shaft portion 12*a*, and the surface of the charging roller 2, and thus cleans the surface of the charging roller 2.

Incidentally, the constitution of the helical cleaning member 12 is not limited to that in this embodiment, but for example, the material and the size of the cleaning portion 12*b* can be appropriately set so as to sufficiently clean the surface of the charging roller 2. However, the helical cleaning member 12 may preferably have a nip width, between the edge portion 12*c* of the cleaning portion 12 and the surface of the charging roller 2, of 50 μm or more and 100 μm or less, preferably of 50-60 μm. In order to realize such a constitution, for example, the strip of the cleaning portion 12*b* can be about 3-10 mm in width, about 1-4 mm in thickness, about 5-40° in winding angle, and about 50-300 gf in load exerted on the charging roller 2 at each of the end portions thereof.

Incidentally, the nip width can be measured in the following manner. The helical cleaning member 12 is contacted to a flat glass plate under substantially the same condition (load or the like) as that during image formation and then is rotated. At this time, a contact portion between the helical cleaning member 12 and the glass plate is shot by a camera provided on a side opposite from the helical cleaning member 12 while irradiating the helical cleaning member 12 with light from an oblique direction to a rectilinear line connecting the camera and the helical cleaning member 12. The nip portion where the edge portion 12*c* of the helical cleaning member 12 contacts the glass surface absorbs the light, and therefore, can be distinguished from a non-contact portion between the helical cleaning member 12 and the glass plate. Thus, a width of the contact portion between the edge portion 12*c* and the glass plate with respect to the direction substantially parallel to the axial direction of the shaft portion 12*a* is the nip width.

Incidentally, in order to use a cleaning blade member in comparison examples (Comparison Examples 1 and 2) described later, a cylindrical cleaning member was also prepared. Part (b) of FIG. 4 is a schematic side view of a cylindrical cleaning member 13 used in the comparison example. The cylindrical cleaning member 13 is constituted by a shaft portion 13*a* and a cylindrical cleaning portion 13*b* provided on an outer peripheral surface of the shaft portion 13*a*. A material of the cleaning portion 13*b* of the cylindrical cleaning member 13 is an urethane sponge which is the same as the urethane sponge of the cleaning portion 12*b* of the helical cleaning member 12 in this embodiment. The cylindrical cleaning member 13 was prepared by inserting the shaft portion 13*a*, onto which an adhesive was applied and which was formed of metal so as to have an outer diameter of 6 mm, into a square bar (material) formed with the urethane sponge and then by polishing the urethane sponge in a cylindrical shape so as to have an outer diameter of 10.7 mm.

3. Contaminant of Charging Member

A mechanism of contamination of the charging roller 2 will be described. The contamination of the charging roller 2 can be roughly described by a mechanism of deposition of the toner from the photosensitive drum 1 onto the charging roller 2 and a mechanism of movement of the toner deposited on the charging roller 2 back from the charging roller 2 to the photosensitive drum 1 by the cleaning member. Incidentally, description will be made on the assumption that the contaminant deposited on the charging roller 2 in the toner as a representative, but can also be the external additive of the toner or paper powder or the like in some cases.

FIG. 5 is a schematic enlarged sectional view of the surface of the charging roller 2 for illustrating the mechanism of the contamination of the charging roller 2 (for convenience, as the projections, only the projections formed by the large particles 21 are shown). The projection formed by the large particle 21 at the surface of the charging roller 2 is referred to as a "projected portion 23". Further, a flat portion between adjacent projections formed by the large particles 21 is referred to as a "flat portion 25". Further, a portion, between the projected portion 23 and the flat portion 25, where a height of the surface of the charging roller 2 gradually changes is referred to as a "base portion 24".

The toner remaining on the surface of the photosensitive drum 1 after the primary transfer is removed and collected from the surface of the photosensitive drum 1 by the cleaning blade 6*a*. However, a part of the toner which is not removed by the cleaning blade 6*a* is fed to the contact portion between the charging roller 2 and the photosensitive drum 1 and then is deposited on the charging roller 2 in some cases. This toner is liable to be deposited on the projected portion 3 at the surface of the charging roller 2 physically contacting the surface of the photosensitive drum 1. Further, the projected portion 23 is one of portions where electric discharge generates between the charging roller 2 and the photosensitive drum 1, and therefore, when the toner is deposited and accumulated on the projected portion 23, the accumulation of the toner loads to improper charging of the photosensitive drum 1.

On the other hand, the toner deposited on the projected portion 23 of the surface of the charging roller 2 is moved to another position of the surface of the charging roller 2 by being moved by the cleaning member contacting the charging roller 2. At this time, typically, the toner is dropped from the projected portion 23 to the base portion 24. Thereafter, when a depositing force between the surface of the charging roller 2 and the toner is low, the toner is moved back from the charging roller 2 to the photosensitive drum 1 by the action of an electric field, so that the surface of the charging roller 2 is cleaned.

4. Evaluation Result

In constitutions of this embodiment (Embodiment 1) and Comparison Examples 1 to 3, a durability test of repetitively outputting an image with an image ratio (print ratio) of 5% was conducted. Further, during the durability test, an image evaluation test in which a half-tone image was outputted and a degree of generation of a vertically stripe image defect due to contamination of the charging roller 2 was checked was conducted. Specifically, in the image evaluation test, a print number in the durability test in which the vertically stripe image defect generated was checked.

Comparison Example 1 has a constitution including the charging roller 2 in which only the above-described large particles 21 are dispersed in the surface layer 2*c* and including the above-described cylindrical cleaning member 13. Comparison Example 2 has a constitution including the charging roller 2 in which the large particles 21 and the small particles 22 are dispersed in the surface layer 2*c* similarly as in this embodiment and including the cylindrical cleaning member 13. Comparison Example 3 has a constitution including the charging roller 2 in which only the large particles 21 are dispersed in the surface layer 2*c* and including the above-described helical cleaning member 12 similarly as in this embodiment. Embodiment 1 (this embodiment) has a constitution including the charging roller 2 in which the large particles 21 and the small particles 22 are dispersed in the surface layer 2*c* and including the helical cleaning member 12. Incidentally, constitutions and operations of image forming apparatuses of Comparison Examples 1 to 3 are substantially the same as those of the image forming apparatus 100 of this embodiment except for the above-described constitutions. A result is shown in Table 1.

TABLE 1

| | Charging roller | | | CM*3 | PN*4 |
|---|---|---|---|---|---|
| | 1P*1 | 2P*3 | Rs (μm) | Kind | (×10³ sheets) |
| EMB. 1 | 5 μm | 15 μm | 12 | H | 200 |
| COMP. EX. 1 | — | 15 μm | 12 | C | 50 |
| COMP. EX. 2 | 5 μm | 15 μm | 12 | C | 50 |
| COMP. EX. 3 | — | 15 μm | 12 | H | 120 |

*1"1P" is the first particles.
*2"2P" is the second particles.
*3"CM" is the Comparison Example member. "H" is the helical cleaning member. "C" is the cylindrical cleaning member.
*4"PN" is the print number at the time of generation of the vertically stripe image defect.

FIGS. 6, 7, 8 and 9 are schematic enlarged sectional views of surfaces of the charging rollers for illustrating behaviors of toners at the surfaces of the charging rollers 2 in Comparison Example 1, Comparison Example 2, Comparison Example 3 and this embodiment (Embodiment 1), respectively.

In Comparison Example 1, the vertically stripe image defect generated at 50,000 sheets. This would be considered due to the following reason. In Comparison Example 1, as shown in FIG. 6, toner t deposited on the projected portion 23 is moved to the base portion 24 by being removed by the cylindrical cleaning member 13 and is accumulated at the base portion 24. The cylindrical cleaning member 13 does not sufficiently follow a portion between adjacent projected portions 23, and therefore, the cylindrical cleaning member 13 moves the toner t deposited on the projected portion 23 but cannot move the toner t accumulated at the base portion 24. As a result, improper charging of the photosensitive drum 1 generates due to the toner t accumulated at the base portion 24, so that the vertically stripe image defect generates.

In Comparison Example 2, the vertically stripe image defect generated at 50,000 sheets. This would be considered due to the following reason. In Comparison Example 2, as shown in FIG. 7, toner t deposited on the projected portion 23 is moved to the base portion 24 by being removed by the cylindrical cleaning member 13 and is accumulated at the base portion 24. Similarly as in Comparison Example 1, the cylindrical cleaning member 13 does not sufficiently follow a portion between adjacent projected portions 23, and therefore, the cylindrical cleaning member 13 moves the toner t deposited on the projected portion 23 but cannot move the toner t accumulated at the base portion 24. As a result, improper charging of the photosensitive drum 1 generates due to the toner t accumulated at the base portion 24, so that the vertically stripe image defect generates.

In Comparison Example 3, the vertically stripe image defect generated at 120,000 sheets. This would be considered due to the following reason. In Comparison Example 3, as shown in FIG. 8, toner t deposited on the projected portion 23 is moved to the base portion 24 by being removed by the helical cleaning member 12 and then is moved to the flat portion 25 by being removed by the helical cleaning member 12. However, as regards the helical cleaning member 13, the number of contact thereof with the surface of the charging roller 2 is decreased by an interval (helical interval R2, winding gap) between adjacent portions of the cleaning portion 12*b*. For that reason, the toner t accumulates at the projected portion 23 and the flat portion 25. As a result, the vertically stripe image defect due to the improper charging of the photosensitive drum 1 generates. In Comparison Example 3, a toner accumulation portion is distributed to the projected portion 23 and the flat portion 25, and therefore, the print number in which the vertically stripe image defect generates is increased (improved) compared with Comparison Example 1, but an effect of removing the contaminant on the charging roller 2 is not sufficient.

On the other hand, in this embodiment, the vertically stripe image defect did not generate up to 200,000 sheets. This would be considered due to the following reason. In this embodiment, as shown in FIG. 9, toner t deposited on the projected portion 23 is moved to the base portion 24 by being removed by the cylindrical cleaning member 13 and then is moved to the flat portion 25 by being removed by the helical cleaning member 12. Here, the toner t moved to the flat portion 25 is reduced in depositing force to the surface of the charging roller 2 by the projections formed by the small particles. As a result, cleaning power in which the charging roller 2 is cleaned by the helical cleaning member 12 can be improved.

As described above, according to this embodiment, in a simple constitution advantageous in cost reduction, the contaminant on the charging roller 2 is remarkably reduced by suppressing the accumulation of the contaminant on the charging roller 2, so that lifetime extension of the charging roller 2 can be realized.

Embodiment 2

Next, another embodiment of the present invention will be described. Basic constitutions and operations of an image forming apparatus in this embodiment are the same as those of the image forming apparatus in Embodiment 1. Accordingly, in the image forming apparatus in this embodiment, elements having the same or corresponding functions and constitutions as those in the image forming apparatus in Embodiment 1 are represented by the same reference numerals or symbols as those in Embodiment 1 and will be omitted from detailed description.

In recent years, in order to realize lifetime extension of the photosensitive drum 1, the surface layer (layer positioned on an outermost surface of the photosensitive drum 1 (outermost layer)) of the photosensitive drum 1 has been increased in hardness (i.e., decreased in wearing degree). For example, as the surface layer of the photosensitive drum 1, a protective layer formed with a curable resin material as a binder resin material in some cases (Japanese Patent No. 3944072 or the like).

FIG. 10 is a schematic sectional view showing a layer structure of the photosensitive drum 1 in this embodiment. In this embodiment, the photosensitive drum 1 is a negatively chargeable drum-shaped organic photosensitive member (OPC) in which an original material is used as a photo-conductive material (charge generating material and charge transporting material) similarly as in Embodiment 1. This photosensitive drum 1 has a lamination structure in which on a substrate (electroconductive substrate) 1*a*, three layers consisting of a charge generating layer 1*b*, a charge transporting layer 1*c* and a protective layer 1*d* are laminated from below in a named order. Further, between the substrate 1*a* and the charge generating layer 1*b*, an intermediary layer (undercoat layer) having a barrier function and an adhesive function and an electroconductive layer for preventing an interference fringe may also be provided. In this embodiment, the protective layer 1*d* is formed using a curable phenolic resin material as the binder resin material. Incidentally, the binder resin material of the surface layer of the photosensitive drum 1 is not limited thereto, but an arbitrary available curable material can be used. For example, a technique such that a cured film obtained by curing a monomer having a C═C (double) bond with heat or light energy is used as the surface layer of the photosensitive drum 1. Further, in this embodiment, the surface layer of the photosensitive drum 1 is the protective layer, but this protective layer may also contain electroconductive particles. The surface layer of the photosensitive drum 1 may also have, in addition to a function as the protective layer, a function as the charge transporting layer (even when another charge transporting layer is provided under the charge transporting layer, these layers may also be regarded as substantially a single charge transporting layer) containing a charge transporting material.

In this embodiment, an elastic deformation rate of the surface of the photosensitive drum 1 is 47% or more (particularly, 48% in this embodiment). As a result, abrasion of the surface of the photosensitive drum 1 due to friction between the surface of the photosensitive drum 1 and the cleaning blade 6*a* is suppressed, so that lifetime extension of the photosensitive drum 1 is realized.

The elastic deformation rate (elastic deformation power) is a value measured using a microhardness measuring device ("FISHER SCOPE H100V", manufactured by Fisher Instruments K.K.) in an environment of 25° C./50% RH (relative humidity). This device is capable of acquiring a continuous hardness by causing a penetrator (indenter) to contact a measuring object (surface of the photosensitive drum 1) and then by directly reading an indentation depth under a load continuously exerted on the penetrator (indenter). As the indenter, a Vickers quadrangular pyramid diamond indenter with an angle between opposite forces of 136 degrees is used. A final load continuously exerted on the indenter is 6 mN, a retention time in which a state that the final load of 6 mN is exerted on the indenter is retained was 0.1 sec. Further, the number of measuring points was 273 points.

FIG. 11 is a graph for illustrating a measuring method of the elastic deformation rate of the surface of the photosensitive drum 1. In FIG. 11, the ordinate represents a load F (mN) exerted on the penetrator (indenter), and the abscissa represents an indentation depth h (μm) of the penetrator (indenter). FIG. 11 shows a result when the load exerted on the indenter is stepwisely increased up to a maximum (6 mN in this case) (A to B), and then is stepwisely decreased (B to C). The elastic deformation rate (elastic deformation power) can be acquired from a change in amount of work (energy) of the indenter on the measuring object (surface of the photosensitive drum 1), i.e., a change in energy caused by increase and decrease of the load of the indenter on the measuring object (surface of the photosensitive drum 1). Specifically, a value obtained by dividing an elastic deformation work amount We by an entire work amount Wt (We/Wt) is the elastic deformation rate (represented by percentage (%)). The entire work amount Wt is represented by an area of a region enclosed by A-B-D-A in FIG. 11, and the elastic deformation work amount We is represented by an area of a region enclosed by C-B-D-C in FIG. 11.

When the elastic deformation rate of the surface of the photosensitive drum 1 is excessively small, an elastic force of the surface of the photosensitive drum 1 is insufficient, so that abrasion of the surface of the photosensitive drum 1 is liable to generate at a contact portion between the photosensitive drum 1 and a contact member such as the cleaning blade 6*a*. The elastic deformation rate of the surface of the photosensitive drum 1 is made 47% or more, whereby it turns out that lifetime extension of the photosensitive drum 1 can be realized by remarkably suppressing the abrasion of the surface of the photosensitive drum 1 compared with the case where the elastic deformation rate is less than 47%. On the other hand, when the elastic deformation rate of the surface of the photosensitive drum 1 is excessively large, an amount of plastic deformation of the surface of the photosensitive drum 1 also becomes large that minute scars on the surface of the photosensitive drum 1 are liable to generate at a contact portion between the photosensitive drum 1 and a contact member such as the cleaning blade 6*a*. For that reason, it turns out that the elastic deformation rate of the surface of the photosensitive drum 1 may preferably be made 60% or less. Incidentally, the elastic deformation rate of the surface of the photosensitive drum 1 can be adjusted depending on a combination of a material with a manufacturing condition.

In constitutions of this embodiment (Embodiment 2) and Comparison Example 4, a durability test of repetitively outputting an image with an image ratio (print ratio) of 5% was conducted. Further, during the durability test, an image evaluation test in which a half-tone image was outputted and a degree of generation of a vertically stripe image defect due to contamination of the charging roller 2 was checked was conducted in the same manner as that described in Embodiment 1.

Comparison Example 4 has a constitution including the charging roller 2 in which only the large particles 21 are dispersed in the surface layer 2*c* and which is the same as the charging roller 2 in Comparison Example 3 and including the above-described helical cleaning member 12 similarly as in this embodiment and the above-described photosensitive drum 1. Embodiment 2 (this embodiment) has a constitution including the charging roller 2, which is the same as the charging roller 2 in Embodiment 1, in which the large particles 21 and the small particles 22 are dispersed in the surface layer 2*c* and including the helical cleaning member 12 which is the same as the helical cleaning member 12 in Embodiment 1 and further including the above-described photosensitive drum 1. Incidentally, a constitution and an operation of image forming apparatus of Comparison Example 4 are substantially the same as those of the image forming apparatus 100 of this embodiment except for the above-described constitution. A result is shown in Table 2.

TABLE 2

| | Charging roller | | | CM*3 | PN*4 |
|---|---|---|---|---|---|
| | 1P*1 | 2P*3 | Rs (μm) | Kind | (×10³ sheets) |
| EMB. 2 | 5 μm | 15 μm | 12 | H | 300 |
| COMP. EX. 4 | — | 15 μm | 12 | H | 80 |

*1"1P" is the first particles.
*2"2P" is the second particles.
*3"CM" is the Comparison Example member. "H" is the helical cleaning member. "C" is the cylindrical cleaning member.
*4"PN" is the print number at the time of generation of the vertically stripe image defect.

In Comparison Example 4, the vertically stripe image defect generated at 80,000 sheets. This would be considered due to the following reason. In Comparison Example 1, the lifetime extension of the photosensitive drum 1 is realized by increasing the hardness of the surface layer of the photosensitive drum 1. However, in such a constitution, there is a tendency that the surface of the photosensitive drum 1 caves in by friction with, for example, a carrier of the developer and thus a hole is easily formed. For that reason, in such a constitution, due to a gap between the cleaning blade 6*a* and the hole, there is a tendency that the toner and the external additive are liable to slip through the cleaning blade 6*a* and thus the contaminant is liable to deposit on the charging roller 2. For that reason, in Comparison Example 4, compared with 120,000 sheets (Table 1) of Comparison Example 3, the degree of contamination of the charging roller 2 is worsened.

On the other hand, in this embodiment, the vertically stripe image defect did not generate up to 300,000 sheets. This would be considered due to the following reason. That is, in addition to the effect described as to Embodiment 1, the toner lowered in depositing force to the charging roller 2 can be moved to the hole of the surface of the photosensitive drum 1 and thus the cleaning power in which the charging roller 2 is cleaned by the helical cleaning member 12 is improved.

As described above, according to this embodiment, similarly as in Embodiment 1, in a simple constitution advantageous in cost reduction, not only accumulation of the contaminant on the charging roller 2 is suppressed and thus the lifetime extension of the charging roller 2 can be realized, but also the cleaning power in which the charging roller 2 is cleaned by the helical cleaning member 12 is further improved.

Embodiment 3

Next, another embodiment of the present invention will be described. Basic constitutions and operations of an image forming apparatus in this embodiment are the same as those of the image forming apparatus in Embodiment 1. Accordingly, in the image forming apparatus in this embodiment, elements having the same or corresponding functions and constitutions as those in the image forming apparatus in Embodiment 1 are represented by the same reference numerals or symbols as those in Embodiment 1 and will be omitted from detailed description.

When the hardness of the surface layer of the photosensitive drum 1 is increased, a frictional force between the photosensitive drum 1 and the cleaning blade 6*a* increases, so that the shuddering (abnormal vibration), the turning-up (phenomenon that a free end of the cleaning blade 6*a* is turned up with respect to the rotational direction of the photosensitive drum 1), chipping and abrasion (wearing) of the cleaning blade 6*a* are liable to generate. Therefore, in order to suppress the above inconveniences by controlling the frictional force between the photosensitive drum 1 and the cleaning blade 6*a*, the surface of the photosensitive drum 1 is provided with a plurality of independent recesses (recessed portions) (Japanese Patent No. 4101278).

In this embodiment, on the surface (specifically, the surface of the protective layer 1*d* similar to that in Embodiment 2) of the photosensitive drum 1, the plurality of independent recesses as described above are formed. FIG. 12 is a schematic view of a part of the surface of the photosensitive drum 1 in this embodiment as seen in a vertical direction of the surface of the photosensitive drum 1.

Circular portions (each having a downward dome-shape in cross-section substantially parallel to a circumferential direction of the photosensitive drum 1 in FIG. 12 are specific recesses, an a portion other than the circular portions is a flat portion.

Typically, the recesses are provided so that when a square region having one side is parallel to the rotational direction of the develop and having each side of 500 μm (500 μm×500 μm) is provided at an arbitrary position of the surface of the photosensitive drum 1, an areal ratio of the specific recesses satisfying a predetermined condition in this region is a predetermined value.

Here, definitions and the like of the specific recesses and the flat portion in the 500 μm-square region will be described. The specific recesses and the flat portion of the surface of the photosensitive drum 1 can be observed with, for example, a laser microscope, an optical microscope, an electron microscope, an atomic force microscope or the like. First, the surface of the photosensitive drum 1 is observed with the microscope or the like in an enlarged state. In the case where the surface of the photosensitive drum 1 is a curved surface such that the photosensitive drum surface is curved along the rotational direction of the photosensitive drum 1, a cross-sectional profile of the curved surface is extracted and the curved line is subjected to fitting. The cross-sectional profile is corrected so that the curved line is a rectilinear line, and a plane obtained by extending the resultant rectilinear line in the longitudinal direction of the photosensitive drum 1 is a reference plane. A region in which a height difference from the resultant reference plane falls within a predetermined range (for example within ±0.2 μm) is defined as the flat portion of the 500 μm-square region. Portions positioned under the flat portion are defined as the (specific) recesses. Further, as regards a depth and a maximum opening diameter, a maximum diameter from the flat portion to bottoms of the recesses is a depth of the recesses, and cross-sectional portions of the recesses at a level of the flat portion are openings of the recesses. Of lengths of line segments crossing the openings, the length of the longest line segment is the maximum opening diameter of the recesses.

The recesses of the surface of the photosensitive drum 1 can be formed by a method (imprinting) in which a mold having a predetermined shape is press-contacted the surface of the photosensitive drum 1 and the predetermined shape is transferred onto the photosensitive drum surface. For example, the mold is continuously contacted to the surface (peripheral surface) of the photosensitive drum 1 by a press-contact shape transfer processing device including the mold while rotating the photosensitive drum 1, and the photosensitive drum surface is processed by the processing device. As another method, a method in which recesses having a predetermined shape are formed on the surface of the photosensitive drum 1 or the like method is also known.

Incidentally, the plurality of specific recesses provided on the peripheral surface of the photosensitive drum 1 may be such that all the specific recesses have the same shape, maximum opening diameter and depth, but may also be such that the specific recesses include those different in shape, maximum opening diameter and depth in mixture. Further, the shape of the specific recesses (i.e., both of a surface shape as seen in a normal direction to the surface of the photosensitive drum 1 and a cross-sectional shape substantially parallel to the circumferential direction of the photosensitive drum 1) is not limited to the above-described shape in this embodiment, but may also be an arbitrary shape as desired. As the shape, for example, a circular shape, an elliptical shape, a square shape, a rectangular shape, and polygonal shapes such as a triangular shape, a quadrangular shape, a pentagonal shape and a hexagonal shape can be cited. Further, the specific recesses may also be disposed in proper alignment or a random alignment.

In this embodiment, the recesses are formed on the surface of the photosensitive drum 1 by imprinting. Further, in this embodiment, the specific recesses have a circular shape of 30 μm in maximum opening diameter (size) when viewed from the normal direction to the surface of the photosensitive drum 1, and have a depth of 0.7 μm and an areal ratio of 56%. Incidentally, the areal ratio of the specific recesses is a proportion (represented by a percentage (%)) of a total of opening areas of the specific recesses to the sum of the total of opening areas of the specific recesses and a total of areas of portions other than the specific recesses.

Similarly as in the case of the holes of the surface of the photosensitive drum 1 described in Embodiment 2, the recesses of the surface of the photosensitive drum 1 not only causes the toner to slip through the cleaning blade 6*a* but also causes the toner lowered in depositing force on the charging roller 2 to move to the recesses. For that reason, also in this embodiment, similarly as in Embodiment 2, the charging roller 2 cleaning power is improved.

As described above, according to this embodiment, similarly as in Embodiment 1, in a simple constitution advantageous in cost reduction, not only accumulation of the contaminant on the charging roller 2 is suppressed and thus the lifetime extension of the charging roller 2 can be realized, but also the cleaning power in which the charging roller 2 is cleaned by the helical cleaning member 12 is further improved.

Other Embodiments

The present invention was described based on the specific embodiments mentioned above, but is not limited to the above-mentioned embodiments.

In the above-described embodiments, as the charging type, the DC charging type was employed, but the present invention is not limited thereto and is also applicable to a constitution employing an AC charging type.

Further, in the above-described embodiments, the projections are formed on the surface of the charging roller by dispersing the surface (layer) particles in the surface layer of the charging roller, but the method of forming the projections on the surface of the charging roller is not limited to the method of dispersing the surface particles. For example, during formation of the surface layer of the charging roller or after the formation of the surface layer of the charging roller, relatively large first projections and relative small second projections are formed (imprinted) with a mold, or these first and second projections may also be formed by polishing the surface of the charging roller.

Further, in the above-described embodiments, two kinds of projections consisting of the first projections and the second projections are formed on the surface of the charging roller, but three kinds or more of projections different in size may also be formed. For example, first projections similar to those of the above-described embodiments, second projections smaller than the first projections, and third projections smaller than the second projections may also be formed by dispersing first, second and third surface particles having different sizes in the surface layer of the charging roller.

Further, in the above-described embodiments, the image forming apparatus was the color image forming apparatus including the plurality of image forming portions, but the present invention is also applicable to a monochromatic (single color) image forming apparatus including only one image forming portion.

Further, the charging member is not limited to the roller-shaped member, but may also be a member, which is stretched by a plurality of stretching rollers and which is formed in an endless belt shape or in a blade shape. The image bearing member is not limited to the drum-shaped photosensitive member (photosensitive drum), but may also be an endless belt-shaped photosensitive member (photosensitive member belt). When the image forming apparatus is of an electrostatic recording type, the image bearing member is an electrostatic recording dielectric member formed in a drum shape or in an endless belt shape.

Further, in the above-described embodiments, the cleaning portion of the cleaning member was formed with the elastic foam. The elastic foam may preferably be used since the elastic foam has high power of removing the contaminant from the cleaning member, but the cleaning portion may also be formed of another material, typically an elastic material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-118141 filed on Jun. 15, 2017, which is hereby incorporated by reference herein in its entirety.

What is claimed is:

1. An image forming apparatus comprising:

a photosensitive member;

a charging roller contacting the photosensitive member and configured to electrically charge the photosensitive member by being supplied with a voltage, wherein the charging roller has an outermost surface layer including an electroconductive resin material, first surface particles having an average particle size of more than 7 μm and less than 30 μm, and second surface particles having an average particle size of more than 2 μm and less than 6 μm, and wherein the first surface particles and the second surface particles are dispersed in the electroconductive resin material so as to form first projections formed by the first surface particles and second projections formed by the second surface particles, respectively, on a surface of the charging roller;

a cleaning roller contacting the charging roller and configured to clean a surface of the charging roller, wherein the cleaning roller includes a shaft portion and an elastic cleaning portion extending helically around the shaft portion;

an urging member configured to urge the cleaning roller against the charging roller; and an image forming portion configured to form a toner image on the photosensitive member charged by the charging roller and configured to transfer the toner image onto a recording material, wherein the first projections have an average interval Sm of 0.1 mm or more and 0.6 mm or less, and the charging roller has a surface roughness Rz of 6 μm or more and 30 μm or less.

2. An image forming apparatus according to claim 1, wherein the elastic cleaning portion is formed with an elastic foam.

3. An image forming apparatus according to claim 1, wherein a coverage ratio of the shaft portion by the elastic cleaning portion is 40% or more and 90% or less.

4. An image forming apparatus according to claim 1, wherein the first surface particles and the second surface particles satisfy:

A:B=1:10 and 1:50, where the number per unit area of the first surface particles at the surface of the charging roller is A, and the number per unit area of the second surface particles at the surface of the charging roller is B.

5. An image forming apparatus according to claim 1, wherein the first and second surface particles are formed of an acrylic resin material or an acrylic-styrene copolymer.

6. An image forming apparatus according to claim 1, wherein a surface of the photosensitive member has elastic deformation power of 47% or more.

7. An image forming apparatus according to claim 1, wherein at a surface of the photosensitive member, a plurality of independent recesses are formed.

8. A cartridge detachably mountable to an image forming apparatus, the cartridge comprising:

a photosensitive member;

a charging roller contacting the photosensitive member and configured to electrically charge the photosensitive member by being supplied with a voltage, wherein the charging roller has an outermost surface layer including an electroconductive resin material, first surface particles having an average particle size of more than 7 μm and less than 30 μm, and second surface particles having an average particle size of more than 2 μm and less than 6 μm, and wherein the first surface particles and the second surface particles are dispersed in the electroconductive resin material so as to form first projections formed by the first surface particles and second projections formed by the second surface particles, respectively, on a surface of the charging roller;

a cleaning roller contacting the charging roller and configured to clean a surface of the charging roller, wherein the cleaning roller includes a shaft portion and an elastic cleaning portion extending helically around the shaft portion; and an urging member configured to urge the cleaning roller against the charging roller, wherein the first projections have an average interval Sm of 0.1 mm or more and 0.6 mm or less, and the charging roller has a surface roughness Rz of 6 μm or more and 30 μm or less.

9. A cartridge according to claim 8, wherein the elastic cleaning portion is formed with an elastic foam.

10. A cartridge according to claim 8, wherein a coverage ratio of the shaft portion by the elastic cleaning portion is 40% or more and 90% or less.

11. A cartridge according to claim 8, wherein the first surface particles and the second surface particles satisfy:

A:B=1:10 and 1:50, where the number per unit area of the first surface particles at the surface of the charging roller is A, and the number per unit area of the second surface particles at the surface of the charging roller is B.

12. A cartridge according to claim 8, wherein the first and second surface particles are formed of an acrylic resin material or an acrylic-styrene copolymer.

13. A cartridge according to claim 8, wherein a surface of the photosensitive member has elastic deformation power of 47% or more.

14. A cartridge according to claim 8, wherein at a surface of the photosensitive member, a plurality of independent recesses are formed.

* * * * *